US006712717B1

(12) United States Patent
Nakamura et al.

(10) Patent No.: US 6,712,717 B1
(45) Date of Patent: Mar. 30, 2004

(54) SOLID GOLF BALL

(75) Inventors: Atsushi Nakamura, Chichibu (JP); Hisashi Yamagishi, Chichibu (JP); Takashi Maruko, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/492,825

(22) Filed: Jan. 27, 2000

(30) Foreign Application Priority Data

Apr. 1, 1999 (JP) ..... 11-94523

(51) Int. Cl.[7] ..... A63B 37/06
(52) U.S. Cl. ..... 473/374
(58) Field of Search ..... 473/351, 372, 473/371, 377, 367, 368, 373–374

(56) References Cited

U.S. PATENT DOCUMENTS 4,858,924 A * 8/1989 Saito et al. ..... 473/377
5,002,281 A * 3/1991 Nakahara et al. ..... 473/373
5,645,496 A * 7/1997 Endo et al. ..... 473/372
5,702,311 A * 12/1997 Higuchi et al. ..... 473/373
5,711,723 A * 1/1998 Hiraoka et al. ..... 473/374
5,743,817 A * 4/1998 Yamagishi et al. ..... 473/377
5,782,707 A * 7/1998 Yamagishi et al. ..... 473/374
5,813,924 A 9/1998 Yamagishi et al. ..... 472/377
5,830,085 A 11/1998 Higuchi et al. ..... 473/373
5,830,086 A 11/1998 Hayashi et al. ..... 473/376
6,194,505 B1 * 2/2001 Sone et al. ..... 473/371

* cited by examiner

*Primary Examiner*—Raeann Gorden
(74) *Attorney, Agent, or Firm*—Sughrue Mion, PLLC

(57) ABSTRACT

In a solid golf ball comprising a solid core and a cover, provided that a coefficient of restitution at a firing velocity of v m/s is designated by CORv, a ball structure prior to formation of the cover satisfies COR25–COR50≧0.100, and the ball satisfies COR50≧0.740 and COR25–COR50≧0.09. The golf ball's performance depends little on the head speed so that the flight performance of the ball when hit at a low head speed is improved while the flight performance when hit at a high head speed is little deteriorated.

7 Claims, 1 Drawing Sheet

SOLID GOLF BALL

This invention relates to an improved solid golf ball.

BACKGROUND OF THE INVENTION

On solid golf balls having solid cores, a number of attempts have been made to soften the feel of the ball when hit. One common approach is to soften the core. At present, this approach requires use of a relatively hard cover in order to compensate for a loss of resilience. Undesirably, the hard cover tends to reduce the substantial dependency of resilience on speed that the soft core possesses.

In general, the substantial dependency of resilience on speed of golf balls means that the resilience at high head speeds is low, but a very good resilience is exerted in a low head speed region. Such balls are suited for low head speed players.

The soft core technology known thus far, however, fails to impart to the ball high resilience at low head speeds because of the influence of the hard cover.

SUMMARY OF THE INVENTION

An object of the invention is to provide a solid golf ball having improved flight performance in a low head speed region and a soft feel when hit.

The invention is directed to a solid golf ball comprising a solid core and a cover enclosing the core. It was empirically found that if the firing velocity used in the measurement of a coefficient of restitution (COR) and the head speed (HS) upon hitting with a given club are of the same value, the deformation behaviors of the ball upon impact are substantially identical between the measurement of COR and the club hitting. It has been found that by specifying the COR at a firing velocity of the golf ball and the difference of COR in a low HS region (typically 25 m/s) and a high HS region (typically 50 m/s) of both the ball and a ball structure prior to formation of the cover, quite unexpectedly there is obtained a golf ball which is improved in flight performance in the low head speed region without sacrificing the flight performance in the high head speed region and at the same time, has a soft feel when hit.

It has also been found that by specifying the Shore D hardness of the cover material relative to the difference in COR of the ball structure prior to formation of the cover between the low and high HS regions, the gage of the cover, and the contact area of the ball when hit at a velocity of 50 m/s, the speed dependency of resilience of the ball when hit at a relatively low head speed can be enhanced and the above-mentioned advantages are more effectively achievable without sacrificing the resilience or rebound in the high head speed region.

Accordingly, the invention provides a solid golf ball comprising a solid core and a cover. Provided that a coefficient of restitution at a firing velocity of v m/s is designated by CORv, a ball structure prior to formation of the cover satisfies $COR25-COR50 \geqq 0.100$, and the ball satisfies $COR50 \geqq 0.740$ and $COR25-COR50 \geqq 0.09$.

In one preferred embodiment, the cover is formed to a gage of 1.2 to 3.0 mm and of such a material that the Shore D hardness of the cover is not greater than $327.61X+27.239$ wherein X represents (COR25−COR50) of the ball structure prior to formation of the cover. Preferably, the ball structure prior to formation of the cover undergoes a deflection of 2.8 to 5.0 mm under an applied load of 100 kg. Also preferably, the solid golf ball has a contact area of 5.0 to 6.5 $cm^2$ when fired at a firing velocity of 50 m/s.

DESCRIPTION OF THE PREFERRED EMBODIMENTS

The solid golf ball of the invention has at least a spherical solid core and a cover enclosing the core in a concentric fashion. The respective components may be formed of well-known materials by conventional methods.

The core may be formed of well-known rubber compositions. For example, a rubber composition comprising polybutadiene as the base is preferred. The polybutadiene used herein is preferably cis-1,4-polybutadiene having a cis structure of at least 40%. Where desired, another suitable rubber component such as natural rubber, polyisoprene rubber or styrene-butadiene rubber may be compounded with the polybutadiene to give the base rubber. Increasing the polybutadiene component leads to an improvement in resilience. Preferably less than about 10 parts by weight of the other rubber component is blended per 100 parts by weight of polybutadiene.

A crosslinking agent may be included in the rubber composition. Exemplary crosslinking agents are the zinc and magnesium salts of unsaturated fatty acids, such as zinc dimethacrylate and zinc diacrylate, and ester compounds such as trimethylpropane methacrylate. Zinc diacrylate is especially preferred for achieving a high resilience. The crosslinking agent is preferably included in an amount of about 10 to about 40 parts by weight per 100 parts by weight of the base rubber.

A vulcanizing agent is generally compounded in the rubber composition. Peroxides are preferred vulcanizing agents. It is recommended that the vulcanizing agent include a peroxide having a one minute half-life temperature of not higher than 155° C., and such peroxide account for at least about 30%, more preferably about 40 to 70% by weight of the entire vulcanizing agent. Examples of suitable peroxides include commercially available products such as Perhexa 3M (dicumyl peroxide, manufactured by Nippon Oils and Fats Co., Ltd.). The amount of vulcanizing agent included in the rubber composition is preferably from about 0.6 to about 2 parts by weight per 100 parts by weight of the base rubber.

If necessary, other suitable ingredients may also be incorporated in the rubber composition, such as antioxidants and fillers (e.g., zinc oxide, barium sulfate) for modifying the specific gravity. The amount of the gravity adjuster blended is typically about 1 to 30 parts by weight per 100 parts by weight of the base rubber.

Production of the core from the rubber composition may be carried out by a known method involving molding and vulcanizing or curing steps.

Around the core, an intermediate layer can be formed from a similar rubber composition or a thermoplastic resin base composition. Specifically, the intermediate layer may be formed by using a suitable material selected from among ionomer resins and thermoplastic elastomers such as polyurethane elastomers, polyamide elastomers and polyester elastomers, and molding the material around the core by a conventional injection molding process. The intermediate layer may be formed to a single layer or a multilayer structure of two or more layers.

As used herein, the term "ball structure prior to formation of the cover" means the core itself when the golf ball has a two-layer structure consisting of a core and a cover. When the golf ball further has an intermediate layer between the core and the cover as mentioned just above, a sphere having the core enclosed with the intermediate layer is meant by the ball structure.

The ball structure prior to formation of the cover preferably has a deflection of 2.8 to 5.0 mm, more preferably 3.0 to 4.8 mm, and most preferably 3.0 to 4.6 mm, under an applied load of 100 kg. A deflection of less than 2.8 mm may lead to a too high hardness and make it difficult to increase the speed dependency of resilience. A deflection in excess of 5.0 mm may lead to poor resilience.

Though not critical, the ball structure prior to formation of the cover generally has an outer diameter of 36.7 to 40.3 mm, and especially 37.5 to 39.8 mm.

The ball structure prior to formation of the cover may be a single layer (that is, the core alone) or have a multilayer structure of two or more layers (that is, the core enclosed with the intermediate layer or layers), with the multilayer structure being preferred. In the multilayer embodiment, the ball structure as a whole may fall within the above-indicated ranges of the deflection under 100 kg load and the outer diameter. Where the intermediate layer is formed, it preferably has a thickness or gage of 0.5 to 5.0 mm, and especially 1.0 to 4.5 mm.

According to the invention, the ball structure prior to formation of the cover and the ball each should have a specific difference between the coefficients of restitution (COR) at predetermined firing velocities.

Coefficient of restitution (COR) is measured by firing a golf ball or a ball structure prior to formation of the cover in a pneumatic cannon at a velocity (referred to as firing velocity) against a steel plate which is positioned apart from the muzzle of the cannon. The rebound velocity is then measured. The rebound velocity is divided by the forward velocity to give the coefficient of restitution. A COR value which is more approximate to unity (1) indicates higher resilience. The invention uses the nomenclature that a coefficient of restitution at a firing velocity of v m/s is designated by CORv. That is, COR's at firing velocities of 25 m/s and 50 m/s are designated COR25 and COR50, respectively.

According to the invention, the ball structure prior to formation of the cover should satisfy COR25−COR50≧0.100, preferably COR25−COR50≧0.105, and more preferably COR25−COR50≧0.110. If this difference is less than 0.100, the speed dependency of resilience of the ball cannot be enhanced.

Specifically stated, it is recommended that the ball structure prior to formation of the cover have a COR value of 0.80 to 0.90, especially 0.82 to 0.88 at a firing velocity of 25 m/s, and 0.70 to 0.80, especially 0.72 to 0.78 at a firing velocity of 50 m/s. Outside the ranges, it may be difficult to provide the desired difference between COR25 and COR50.

The golf ball of the invention is obtained by forming the cover around the ball structure prior to formation of the cover (i.e., the core alone or the core enclosed with the intermediate layer). According to the invention, the ball should satisfy COR25−COR50≧0.090, preferably COR25−COR50≧0.095, and more preferably COR25−COR50≧0.100. If this difference is less than 0.090, the speed dependency of resilience of the ball cannot be enhanced.

Additionally, the invention requires that the ball have a COR of at least 0.740 at a firing velocity of 50 m/s (that is, COR50≧0.740), preferably at least 0.745 and more preferably at least 0.750 at a firing velocity of 50 m/s. The COR of the ball at a firing velocity of 25 m/s need not be specifically limited although the ball preferably have a COR25 of at least 0.830, more preferably at least 0.835, and most preferably at least 0.840. Outside the ranges, it may be difficult to provide the optimum difference between COR25 and COR50 and the desired speed dependency of resilience of the ball.

The golf ball of the invention is prepared by enclosing the core or the core plus the intermediate layer with the cover. The cover may be made of well-known cover stocks such as thermoplastic resins. Suitable materials include ionomer resins and thermoplastic elastomers such as polyurethane elastomers, polyamide elastomers and polyester elastomers.

In forming the cover, a choice is preferably made of a material having an appropriate hardness for the predetermined difference of coefficient of restitution of the ball structure prior to formation of the cover. Provided that X represents (COR25−COR50) of the ball structure prior to formation of the cover and D represents the Shore D hardness of the cover material, it is recommended that the cover material satisfy $$D \geqq 327.61X + 27.239.$$

Specifically, the cover material should preferably have a Shore D hardness of 50 to 65, and especially 53 to 62. A hardness outside the range may detract from the feel and fail to provide good spin performance enough for skilled golfers to accept.

The thickness or gage of the cover is not critical although the cover gage is generally 1.2 to 3.0 mm, preferably 1.5 to 2.5 mm, and especially 1.6 to 2.1 mm. A gage of less than 1.2 mm may detract from ball durability. A cover gage of more than 3.0 mm may offset the speed dependency of resilience of the core, failing to attain the objects of the invention.

Most often, the cover is formed by injection molding of the above-described materials. Of course, other well-known molding techniques such as compression molding are employable.

In the practice of the invention, the golf ball satisfying the above-mentioned requirements of COR and COR difference can be obtained by properly selecting the material type, vulcanizing conditions and deflection of the core, the material type, hardness and gage of the optional intermediate layer, and the material type, hardness and gage of the cover.

The golf ball of the invention can be prepared by injection molding the above-described cover material around the ball structure prior to formation of the cover in a conventional manner. Like conventional golf balls, the golf ball of the invention has numerous dimples formed in the surface of the cover. The shape and arrangement of dimples are selected as appropriate from well-known ones.

The golf ball of the above construction preferably has a deflection of 2.4 to 3.8 mm and especially 2.6 to 3.5 mm under an applied load of 100 kg.

Further preferably, the golf ball has a contact area of 5.0 to 6.5 $cm^2$, more preferably 5.2 to 6.3 $cm^2$, and most preferably 5.4 to 6.0 $cm^2$, when fired at a firing velocity of 50 m/s. A contact area of less than 5.0 $cm^2$ may lead to a hard feel whereas a contact area of more than 6.5 $cm^2$ may detract from resilience.

The inventive golf ball may be formed so as to have a diameter and weight which conform with the Rules of Golf, that is, a diameter of not less than 42.67 mm and a weight of not greater than 45.93 g.

EXAMPLE

Figure 1:
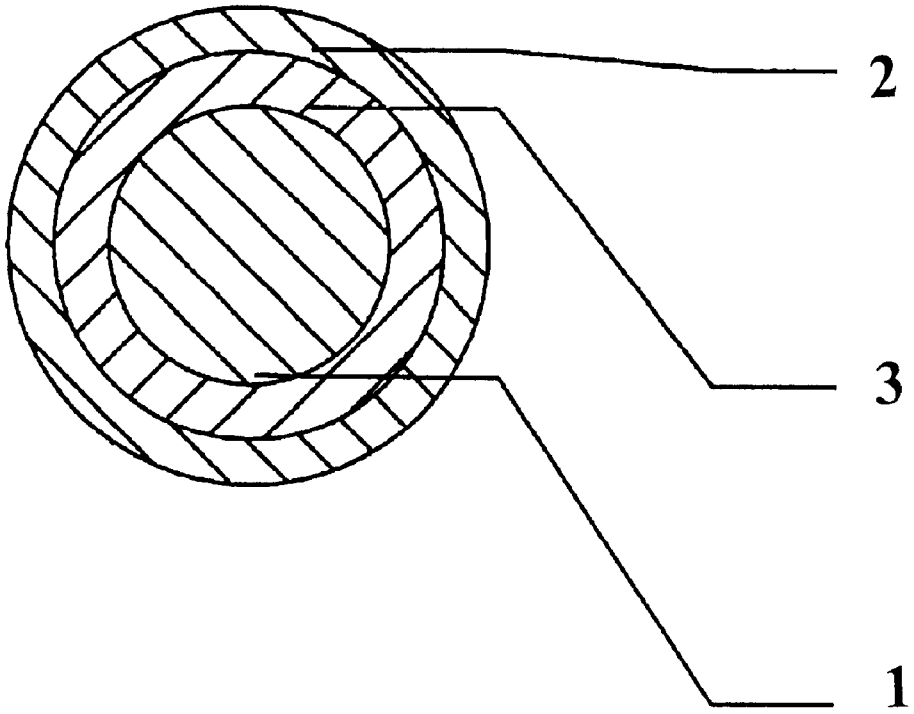
FIG. 1 shows a golf ball having a core 1, a cover 2 and an intermediate layer 3.

Examples of the invention are given below by way of illustration and not by way of limitation.

Examples 1–4 and Comparative Examples 1–4

Using the materials of the formulation shown in Table 1, cores were formed, and optional intermediate layers and covers were formed around the cores by injection molding. In this way, there were obtained golf balls bearing identical dimples.

The golf balls were examined as follows, with the results shown in Table 1.

Flight distance

Using a swing robot, the ball was hit with a driver (W#1, trade name "230Ti" with a loft 9.5°, by Bridgestone Sports Co., Ltd.) at a head speed of 35 m/s (HS35) and 50 m/s (HS50). A carry and a total distance (carry plus run) were measured.

COR

Coefficient of restitution (COR) was measured by firing the ball in a pneumatic cannon at a velocity of 25 m/s or 50 m/s against a steel plate which is positioned apart from the muzzle of the cannon. The rebound velocity was then measured. The rebound velocity is divided by the forward velocity to give the COR.

Contact area

As in the measurement of COR, the ball was fired at a velocity of 50 m/s against a pressure-sensitive paper sheet on the steel plate. A contact area was determined from the imprint on the paper by the ball.

Feel

The feel of the golf ball when hit with a driver (W#1) was rated as follows by three golfers.

Good: Three golfers got an appropriate soft and solid feel.

Fair: Two golfers got an appropriate soft and solid feel.

Poor: Three golfers felt too soft.

TABLE 1

| | EX 1 | EX 2 | EX 3 | EX 4 | CE 1 | CE 2 | CE 3 | CE 4 |
|---|---|---|---|---|---|---|---|---|
| Core formulation (pbw) | | | | | | | | |
| Cis-1,4-polybutadiene | 100 | 100 | 100 | 100 | 100 | 100 | 100 | 100 |
| Zinc diacrylate | 25.3 | 18.4 | 22.2 | 13.0 | 23.8 | 20.7 | 11.5 | 34.5 |
| Barium sulfate | 17.3 | 20.4 | 18.7 | 29.6 | 18.0 | 22.8 | 23.5 | 13.2 |
| Zinc oxide | 5.0 | 5.0 | 5.0 | 5.0 | 5.0 | 5.0 | 5.0 | 5.0 |
| Antioxidant | 0.2 | 0.2 | 0.2 | 0.2 | 0.2 | 0.2 | 0.2 | 0.2 |
| Dicumyl peroxide | 1.2 | 1.2 | 1.2 | 1.2 | 1.2 | 1.2 | 1.2 | 1.2 |
| Intermediate layer formulation (pbw) | | | | | | | | |
| Himilan 1557 | — | — | — | 50 | — | — | — | — |
| Himilan 1601 | — | — | — | 50 | — | — | — | — |
| Hytrel 4767 | — | — | 100 | — | — | — | 100 | — |
| Cover formulation (pbw) | | | | | | | | |
| Himilan 1601 | — | — | — | 50 | — | — | — | 50 |
| Himilan 1557 | — | 50 | — | 50 | — | 50 | 50 | 50 |
| Himilan 1605 | 50 | 50 | 50 | — | — | 50 | 50 | — |
| Himilan 1706 | 50 | — | 50 | — | 50 | — | — | — |
| Surlyn 8150 | — | — | — | — | 50 | — | — | — |
| Core | | | | | | | | |
| Outer diameter (mm) | 39.1 | 39.1 | 36.3 | 36.3 | 39.1 | 36.3 | 36.3 | 39.1 |
| Weight (g) | 36.2 | 36.2 | 29.1 | 30.1 | 36.2 | 29.6 | 29.1 | 36.2 |
| Intermediate layer | | | | | | | | |
| Shore D hardness | — | — | 47 | 58 | — | — | 47 | — |
| Core or Core + intermediate layer | | | | | | | | |
| Outer diameter (mm) | 39.1 | 39.1 | 39.1 | 39.1 | 39.1 | 36.3 | 39.1 | 39.1 |
| Weight (g) | 36.2 | 36.2 | 36.2 | 36.2 | 36.2 | 29.6 | 36.2 | 36.2 |
| Deflection under 100-kg load (mm) | 3.4 | 4.3 | 3.8 | 4.2 | 3.6 | 4.0 | 5.0 | 2.2 |

TABLE 1-continued

| | EX 1 | EX 2 | EX 3 | EX 4 | CE 1 | CE 2 | CE 3 | CE 4 |
|---|---|---|---|---|---|---|---|---|
| COR25 | 0.835 | 0.857 | 0.839 | 0.859 | 0.826 | 0.842 | 0.839 | 0.831 |
| COR50 | 0.712 | 0.720 | 0.703 | 0.727 | 0.705 | 0.722 | 0.694 | 0.738 |
| COR25–COR50 | 0.123 | 0.137 | 0.136 | 0.132 | 0.121 | 0.120 | 0.145 | 0.093 |
| Cover | | | | | | | | |
| Shore D hardness | 62 | 60 | 62 | 58 | 68 | 60 | 60 | 58 |
| Gage (mm) | 1.8 | 1.8 | 1.8 | 1.8 | 1.8 | 3.2 | 1.8 | 1.8 |
| Ball | | | | | | | | |
| COR25 | 0.860 | 0.860 | 0.857 | 0.858 | 0.847 | 0.841 | 0.840 | 0.840 |
| COR50 | 0.759 | 0.751 | 0.755 | 0.750 | 0.759 | 0.755 | 0.732 | 0.759 |
| COR25–COR50 | 0.101 | 0.109 | 0.102 | 0.108 | 0.088 | 0.086 | 0.108 | 0.081 |
| Contact area ($cm^2$) | 5.45 | 5.67 | 5.50 | 5.70 | 5.24 | 5.38 | 5.97 | 4.91 |
| W #1/HS35 | | | | | | | | |
| Carry (m) | 139.0 | 138.5 | 138.5 | 137.0 | 133.0 | 133.5 | 132.0 | 131.0 |
| Total (m) | 155.0 | 156.2 | 154.0 | 153.8 | 150.0 | 149.0 | 150.5 | 148.5 |
| W #1/HS50 | | | | | | | | |
| Carry (m) | 237.0 | 237.5 | 235.4 | 235.0 | 235.0 | 234.0 | 231.0 | 237.4 |
| Total (m) | 256.0 | 253.0 | 254.5 | 253.8 | 254.0 | 253.8 | 243.5 | 256.5 |
| Feel | Good | Good | Good | Good | Fair | Good | Good | Poor |

Note: Himilan is the trade name of ionomer resins, Surlyn is the trade name of ionomer resins, and Hytrel is the trade name of polyester elastomers, all available from E. I. DuPont de Nemours and Company.

As is evident from Table 1, the golf ball of Comparative Example 1 travels a distance when hit at a high head speed, but travels short when hit at a low head speed and gives an unsatisfactory feel since the cover is hard and the difference between COR25 and COR50 is outside the range of the invention. The golf ball of Comparative Example 2 exhibits poor flight performance when hit at a low head speed since the cover is thick and the difference between COR25 and COR50 is outside the range of the invention. The golf ball of Comparative Example 3 exhibits poor flight performance when hit at a low head speed since the ball structure prior to formation of the cover is soft and the COR50 of the ball is lower. The golf ball of 1Comparative Example 4 exhibits a poor feel and does not travel distance when hit at a low head speed since the ball structure prior to formation of the cover is hard and the difference between COR25 and COR50 is outside the range of the invention.

In contrast, all the golf balls within the scope of the invention are improved in flight performance both at low and high head speeds and give a good feel.

There has been described a solid golf ball whose performance depends little on the head speed. The flight performance of the ball when hit at a low head speed is improved while the flight performance when hit at a high head speed is little aggravated. Additionally, the ball presents a good feel when hit.

Japanese Patent Application No. 11-094523 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball comprising a solid core, a cover, and an intermediate layer between the core and the cover, wherein the cover is made of thermoplastic elastomers selected from a group consisting of polyurethane elastomers, polyamide elastomers and polyester elastomers, and the intermediate layer is formed from a material consisting of ionomer resins, a coefficient of restitution at a firing velocity of v m/s is designated by CORv, a ball structure prior to formation of the cover satisfies COR25–COR50≧0.100, and the ball satisfies COR50≧0.740 and COR25–COR50≧0.09, the cover has a Shore D hardness of not greater than 327.61X+27.239 wherein X represents (COR25–COR50) of the ball structure prior to formation of the cover, and the intermediate layer has a Shore D hardness which is not greater than the hardness of the cover, the ball structure prior to formation of the cover undergoes a deflection of 2.8 to 5.0 mm under an applied load of 100 kg, and the solid golf ball has a contact area of 5.0 to 6.5 $cm^2$ when fired at a firing velocity of 50 m/s.

2. The solid golf ball of claim 1 wherein the cover has a gage of 1.2 to 3.0 mm.

3. The solid golf ball of claim 1, wherein the ball structure prior to formation of the cover has a COR25 value of 0.80 to 0.90 and a COR50 value of 0.70 to 0.80, respectively.

4. The solid golf ball of claim 1, wherein the intermediate layer has a gage of 0.5 to 5.0 mm.

5. The solid golf ball of claim 1, wherein the cover has a Shore D hardness of 50 to 65.

6. The solid golf ball of claim 1, wherein the ball has a COR25 value of at least 0.830 and a COR50 value of at least 0.740, respectively.

7. The solid golf ball of claim 1, wherein the ball undergoes a deflection of 2.4 to 3.8 mm under an applied load of 100 kg.

* * * * *